US007513225B2

(12) United States Patent
Geyer et al.

(10) Patent No.: US 7,513,225 B2
(45) Date of Patent: Apr. 7, 2009

(54) INTERNAL COMBUSTION ENGINE

(75) Inventors: Werner Geyer, Berglen (DE); Björn Scherraus, Wildberg-Effringen (DE); Lukas Zürcher, Stuttgart (DE); Patrick Schlauch, Esslingen (DE); Jürgen Häberlein, Murrhardt (DE); Erik Ames, Waiblingen (DE)

(73) Assignee: Andreas Stihl AG & Co. KG (DE)

( * ) Notice: Subject to any disclaimer, the term of this patent is extended or adjusted under 35 U.S.C. 154(b) by 0 days.

(21) Appl. No.: 11/836,098

(22) Filed: Aug. 8, 2007

(65) Prior Publication Data

US 2008/0035091 A1 Feb. 14, 2008

(30) Foreign Application Priority Data

Aug. 9, 2006 (DE) ..... 10 2006 037 202

(51) Int. Cl.
*F02B 25/00* (2006.01)
*F02M 35/10* (2006.01)

(52) U.S. Cl. ..... 123/73 A; 123/184.23; 123/184.61

(58) Field of Classification Search ..... 123/73 R, 123/73 A, 73 PP, 184.21, 184.22, 184.23, 123/184.61

See application file for complete search history.

(56) References Cited

U.S. PATENT DOCUMENTS 4,971,008 A * 11/1990 Morishita ..... 123/184.52
5,065,708 A * 11/1991 Wehle et al. ..... 123/184.61
2005/0045138 A1 3/2005 Schmidt et al.

FOREIGN PATENT DOCUMENTS

EP 1 221 545 5/2004

* cited by examiner

*Primary Examiner*—Noah Kamen
(74) *Attorney, Agent, or Firm*—Robert W. Becker; Robert W. Becker & Assoc.

(57) ABSTRACT

An internal combustion engine having an intake channel for supply of fuel and combustion air, and divided over a portion of its length into a mixture channel, and into a supply channel for supply of largely fuel-free air. A simple manufacture of the engine and a simple construction are achieved if a portion of the intake channel is guided in an elastic intake adapter, whereby the intake adapter has a partition that extends over at least a portion of the length of the intake adapter and divides the intake channel into a mixture channel and a supply channel.

23 Claims, 7 Drawing Sheets

INTERNAL COMBUSTION ENGINE

The instant application should be granted the priority date of Aug. 9, 2007, the filing date of the corresponding German patent application Nr. DE 10 2006 037 202.6.

BACKGROUND OF THE INVENTION

The present invention relates to an internal combustion engine having an intake channel for the supply of fuel and combustion air, whereby the intake channel, over at least a portion of its length, is divided into a mixture channel, and into a supply channel for the supply of largely free-air.

EP 1 221 545 A2 discloses an internal combustion engine, namely a two-cycle engine, the intake channel of which is provided with a partition that separates an air channel from a mixture channel. US 2005/0045138 A1 discloses a connector between a carburetor and an internal combustion engine that is provided with two tubes, namely one tube for a mixture channel and a second, separate tube for the air channel.

It is an object of the present application to provide an internal combustion engine of the aforementioned general type that has a straightforward configuration and that can be produced in a simple manner.

BRIEF DESCRIPTION OF THE DRAWINGS

This object, and further objects and advantages of the present application, will appear more clearly from the following specification in conjunction with the accompanying schematic drawings, in which.

SUMMARY OF THE INVENTION

Figure 1:
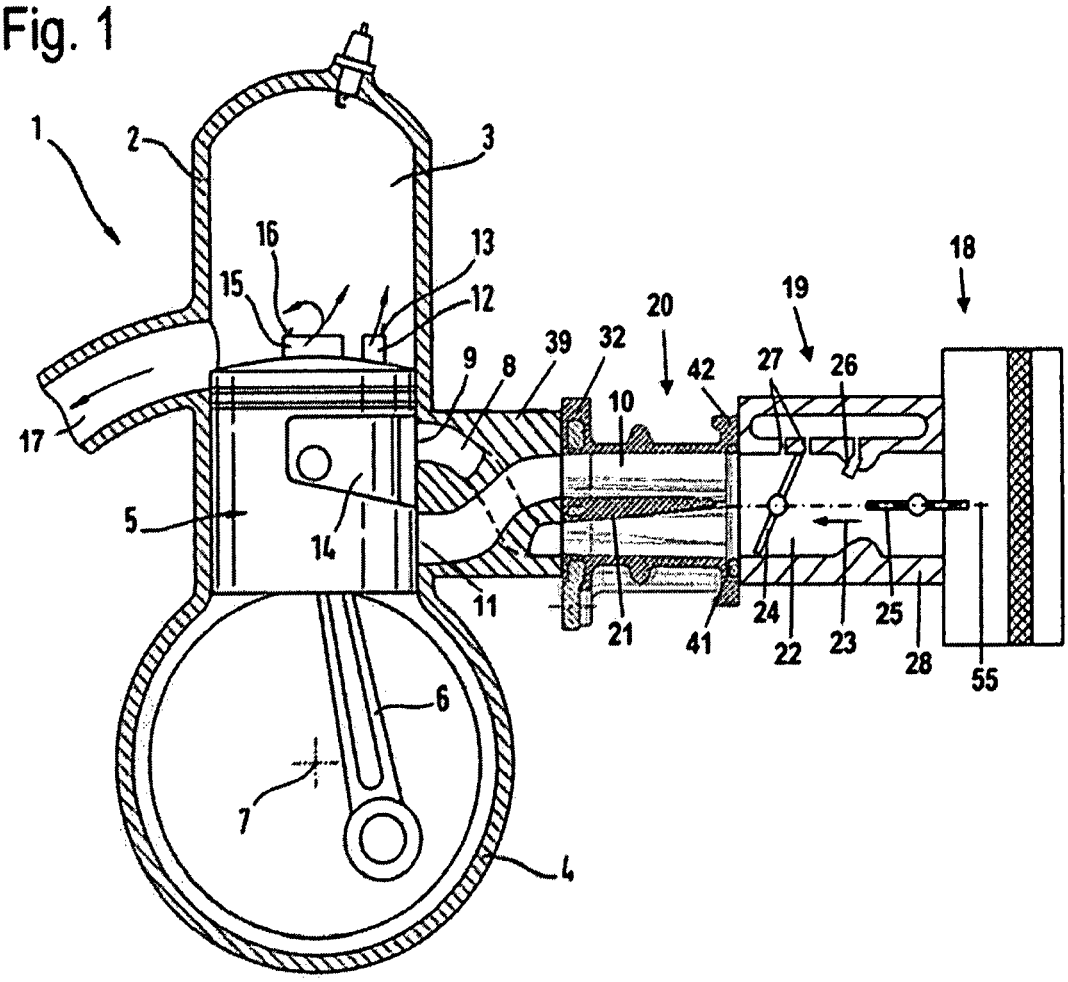
FIG. 1 is a cross-sectional view through a two-cycle engine.

The object of the present application is realized by an internal combustion engine where a portion of the intake channel is guided in an elastic intake adapter which is provided with a partition that extends over at least a portion of the length of the intake adapter and in the adapter divides the intake channel into the mixture channel and the supply channel.

Instead of two separate and distinct conduits or tubes for the mixture channel and the air channel, the internal combustion engine of the present application has an intake channel that is divided into the mixture channel and the supply channel. Due to the fact that the intake adapter is elastic, the intake adapter can bridge a vibration gap, for example the vibration gap in a manually-guided implement, between a handle housing and an engine housing. The intake adapter can be produced in a simple manner, for example in an injection molding process. Due to the fact that the intake adapter has a single conduit that is divided by the partition, the expenditure of material and hence also the weight of the intake adapter are low. The intake adapter requires less installation space then does a comparable intake adapter having two separate conduits or tubes.

The intake adapter is advantageously comprised predominant of a polymeric material, in particular of an elastomer. A straightforward configuration of the intake adapter is achieved if the mixture channel and the supply channel are guided parallel to one another in the intake adapter. At the upstream end of the intake adapter, the intake channel advantageously has a circular cross-section. As a result, the intake adapter can be connected to a carburetor having a circular channel cross-section. The carburetor can thus be easily embodied with a circular carburetor bore.

In the region of its upstream end the intake adapter expediently has an inlet opening into the mixture channel and an inlet opening into the supply channel, with the openings being separated by the partition. Due to the fact that already in the region of the inlet opening a separation exists between mixture channel and supply channel, a passage of fuel out of the mixture channel into the supply channel is largely avoided. The partition advantageously divides the intake channel centrally. However, the flow cross-section of the inlet opening into the mixture channel can be greater than the flow cross-section of the inlet opening into the supply channel. In particular where the internal combustion engine is embodied as a two-cycle engine that operates with forward scavenging, during operation the required quantity of combustion air that is supplied via the supply channel and serves for the temporary holding or collection in the transfer channels, is greater than the required quantity of fuel/air mixture. By configuring the inlet openings into the supply channel and into the mixture channel with different flow cross-sections, an easy adaptation to the internal combustion engine is possible.

The partition can be curved toward the supply channel. The curved configuration of the partition reduces the quantity of fuel that enters the supply channel. The curved configuration of the partition effects a bulging of the partition in a preferred direction. This prevents the partition from deflecting toward the mixture channel. A deflection toward the mixture channel would considerably increase the quantity of fuel supplied to the supply channel, and would thus adversely affect the emission values of the internal combustion engine. To prevent collapse of the partition, the intake adapter, at its upstream end, can be provided with a support ring on which a section of the partition is held, whereby the support ring and the section of the partition are made of an inherently stable material. The support ring and the partition section stabilize the intake adapter at its upstream end. The section of the partition of inherently stable material prevents the partition from collapsing toward one of the channels. The support ring can be produced separately, and can be fixed in position on the intake adapter during assembly. A stabilization of the partition can thus be effected in a straightforward manner. For the stabilization of the partition, the intake adapter can also be provided with a reinforcement plate that is made of an inherently stable material and that forms at least a portion of the partition. In this connection, the reinforcement plate can itself delimit the mixture channel and the supply channel, or can be covered by the elastic material of the intake adapter. If the intake adapter is produced in an injection molding process, the reinforcement plate can be easily injected or incorporated into the intake adapter.

A portion of the intake channel is formed in a carburetor, and the upstream end of the intake adapter is disposed on the carburetor. A straightforward embodiment of the internal combustion engine results if the intake channel in the carburetor is embodied as non-divided conduits. The separation or division of the intake channel into a mixture channel and a supply channel takes place only downstream of the carburetor in the intake adapter. As a result, a conventional carburetor can be used, for example, for a two-cycle engine having forward scavenging. This simplifies the ability to produce the forward scavenging engine. However, it would also be possible to dispose in the carburetor a partition section that divides the intake channel. By disposing a partition section in the carburetor, it is possible to improve the separation between mixture channel and supply channel, and to thus largely avoid passage of fuel from the mixture channel into the supply channel.

An adjustable throttle or flow-control element can be provided in the carburetor that in at least one position, in the region of the partition, extends into the intake adapter. The throttle element advantageously rests against the partition in at least one position. This results in a good separation of mixture channel and supply channel. In particular for a good sealing, a sealing element is provided on the partition or the partition itself is embodied as a sealing surface. However, the partition can also be provided with a recess for the throttle element, and in each position of the throttle element a spacing or gap exists between the partition and the throttle element.

The intake adapter has a carburetor connection flange that serves for the connection to the carburetor and forms the upstream end of the intake adapter. To improve sealing, and to increase stability, the carburetor connection flange has a core made of an inherently stable material that is at least partially covered by the elastic material of the intake adapter. On its downstream end, the intake adapter expediently has an outlet opening for the mixture channel and an outlet opening for the supply channel, whereby the flow cross-section of the outlet opening for the mixture channel is smaller than the flow cross-section of the outlet opening for the supply channel. The internal combustion engine in particular has a cylinder that has a cylinder connector, and the downstream end of the intake adapter is disposed on the cylinder connector. The intake adapter thus connects in particular the carburetor directly with the cylinder connector. This results in a compact and straightforward construction of the internal combustion engine.

The intake adapter advantageously has a cylinder connection flange that serves for the connection to the cylinder connector and that forms the downstream end of the intake adapter. The cylinder connection flange is provided in particular with three mounting openings. If three mounting openings are provided, there is provided a statically defined support of the cylinder connection flange on the cylinder connector. In contrast to the four mounting openings conventionally used for intake adapters, the expense required for mounting is reduced. To increase the stability of the cylinder connection flange, the cylinder connection flange has a core that is made of an inherently stable material and that is at least partially covered by the elastic material of the intake adapter. The core is advantageously not covered in the region of the mounting openings so that a good fixation of the connection flange is possible. A simple configuration of the intake adapter, and a good, sealing connection between intake adapter and cylinder or carburetor, can be achieved if the intake adapter is provided on at least one connection flange with a sealing bead that surrounds the openings for the mixture channel and the supply channel. By means of the mounting openings, a defined pressure of the sealing bead against the cylinder connector can be achieved, so that a sealed connection is ensured between intake adapter and cylinder.

However, the intake adapter can also have a cylinder connection rim, which overlaps the cylinder connector of the cylinder and forms the downstream end of the intake adapter. The intake adapter expediently has a pulse channel that extends from the upstream end of the intake adapter to the downstream end thereof. The pulse channel connects the crankcase of the internal combustion engine with a fuel pump that is disposed in the carburetor. The arrangement of the pulse channel in the intake adapter leads to a compact construction of the internal combustion engine without additional components and without additional assembly expenditure. A good supply of supply channel and mixture channel, and a straightforward manufacturer of the internal combustion engine, can be achieved if a slide-in element is inserted into the intake adapter that extends into the carburetor and separates the mixture channel and the supply channel.

To achieve a good seal between the mixture channel and the supply channel, a throttle or fuel-control element can be disposed in Is the carburetor, and downstream of the throttle element a sealing element can be disposed on an element that forms a partition section. Even in a closed or partially closed position of the throttle element, the sealing element ensures a good separation between mixture channel and supply channel.

An intermediate element or spacer is advantageously disposed between the carburetor and the intake adapter. The spacer is advantageously pressed into the carburetor in a gas tight manner. The spacer is in particular overlapped by a carburetor connection flange of the intake adapter. As a result, the spacer can be premounted on the carburetor, so that during assembly it is merely necessary to install the intake adapter. This results in a straightforward and reliable assembly. The spacer is in particular provided with a partition section that rests against the partition of the intake adapter. As a result, the partition of the intake adapter is supported against the partition section of the spacer. The stability is increased. In this connection, the partition section of the spacer can form a guide for the partition of the intake adapter, for example by means of one or more beveled or chamfered portions.

Further specific features of the present invention will be described in detail subsequently.

DESCRIPTION OF SPECIFIC EMBODIMENTS

Referring now to the drawings in detail, the internal combustion engine shown in FIG. 1 is a two-cycle engine 1 that operates with forward scavenging and that serves in particular for driving the tool of a manually-guided implement, such as a power saw, a cut-off machine, or the like. The two-cycle engine 1 has a cylinder 2 in which is formed a combustion chamber 3. The combustion chamber 3 is delimited by a piston 5 that is reciprocably mounted in the cylinder 2. By means of a connecting rod 6, the piston 5 drives a crankshaft 7 that is rotatably mounted in a crankcase 4. Opening out at the cylinder 2 is a supply channel 8 for largely fuel-free air and a mixture channel 10; the supply channel 8 opens out via a channel inlet 9, and the mixture channel 10 opens out via a mixture inlet 11. The channel inlet 9 and the mixture inlet 11 are port-controlled by the piston 5. An outlet 17 leads out of the combustion chamber 3.

Near the lower dead center position of the piston 5, the crankcase 4 is fluidically connected with the combustion chamber 3 via two transfer channels 12 that are close to the inlet and two transfer channels 15 that are close to the outlet. In FIG. 1, only one of the transfer channels 12, 15 respectively is shown. The second transfer channels 12 and 15 are disposed symmetrically relative to the section plane in FIG. 1. The transfer channels 12 close to the inlet open via transfer windows 13 into the combustion chamber 3, and the transfer channels 15 that are close to the outlet open via transfer windows 16. The piston 5 has a piston pocket 14 that near the upper dead center position of the piston 5 connects the channel inlet 9 with the transfer windows 13 and 16.

The two-cycle engine 1 has an air filter 18 that is connected via a carburetor 19 and an intake adapter 20 to a connector 39 of the cylinder 2. An intake channel 22 is formed in the carburetor 19 and in the intake adapter 20. In the intake adapter 20, the intake channel 22 is divided by a partition 21 into the mixture channel 10 and the supply channel 8. In the adapter 20, the mixture channel 10 and the supply channel 8 extend parallel to one another; the supply channel 8 is guided on that side of the mixture channel 10 that faces the crankcase 4. In the cylinder connector 39, the supply channel 8 and the mixture channel 10 cross one another. At the cylinder 2, the supply channel 8 opens out on that side of the mixture channel 10 that faces the combustion chamber 3.

Figure 2:
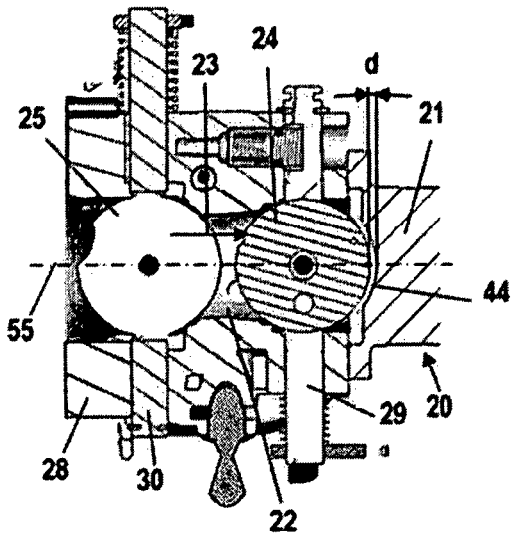
FIGS. 2 & 3 are cross-sectional views of embodiments of the carburetor of the two-cycle engine of FIG. 1.

A butterfly valve 24 having a butterfly valve shaft 29, shown in FIG. 2, is pivatably mounted in the carburetor 19 in the intake channel 22. A choke valve 25 having a choke shaft 30, shown in FIG. 2, is pivotably mounted in the intake channel 22 upstream of the butterfly valve 24 relative to the direction of flow 23. The butterfly valve shaft 29 and the choke shaft 30 are mounted in a carburetor housing 28. Auxiliary fuel openings 27 open out into the intake channel 22 in the region of the butterfly valve 24. A main fuel opening 26 opens out into the intake channel 22 approximately between the choke shaft 30 and the butterfly shaft 29 in the direction of flow 23. The auxiliary fuel openings 27 and the main fuel opening 26 open out into a region of the intake channel 22 that is disposed upstream of the mixture channel 10.

Figure 3:
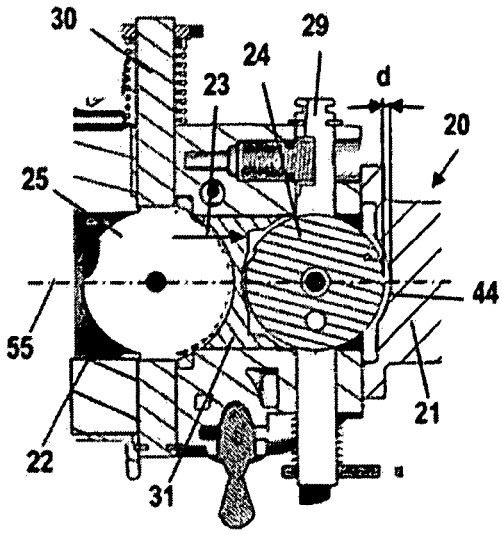

FIG. 3 shows a cross-section through the carburetor 19 at the level of an intake channel longitudinal axis 55 that extends centrally in the intake channel 22. In a completely opened position, the butterfly valve 24 and the choke valve 25 are disposed parallel to the longitudinal axis 55 of the intake channel 22. In this position of the choke valve 25 and the butterfly valve 24, these valves 24, 25 divide the intake channel 22. That portion of the intake channel 22 disposed upstream of the supply channel 8 is screened by the butterfly valve 24 from the fuel openings 26 and 27, so that the fuel essentially passes into the mixture channel 10. As shown in FIG. 2, in the completely opened position the butterfly valve 24 extends into the intake adapter 20 in the region of the partition 21. The partition 21 has a recessed area 44, the contour of which corresponds to the contour of the butterfly valve 24. The recessed area 44 is dimensioned is such a way that in the completely opened position a spacing d is formed between the butterfly valve 24 and the partition 21. The spacing d defines the gap between the butterfly valve 24 and the partition 21 and can, for example, be between several tenths of a millimeter and several millimeters. The gap d is advantageously 0.5 mm to 1 mm.

FIG. 3 shows an embodiment of the carburetor 19 where a partition section 31 is disposed between the choke valve 25 and the butterfly valve 24. In the completely open position, the choke valve 25, the partition section 31, and the butterfly valve 24 are disposed in a plane, so that the intake channel 22 is also divided in the carburetor 19 into a mixture channel 10 and a supply channel 8. Between the butterfly valve 24 and partition 21 a connection is formed between the mixture channel 10 and the supply channel 8 due to the recessed area 44 and the gap d. The partition section 31 is formed as a separate component that is inserted into the channel 22.

When the two-cycle engine 1 is operating, fuel/air mixture is drawn into the crankcase 4 during the upward stroke of the piston 5 via the mixture channel 10. Near the upper dead center position of the piston 5 largely fuel-free air from the supply channel 8 is temporarily stored or held in the transfer channels 12 and 15 via the piston pocket 14. During the downward stroke of the piston 5, the mixture is compressed in the crankcase 4. As soon as the transfer windows 13 and 16 are released by the piston 5, initially fuel-free air, and subsequently fresh mixture, flow out of the crankcase 4 and into the combustion chamber 3. Exhaust gases from the preceding cycle in the combustion chamber 3 are scavenged by the largely fuel-free air out of the combustion chamber 3 and into the outlet 17. During the upward stroke of the piston 5, the mixture in the combustion chamber 3 is compressed and is ignited near the upper dead center position of the piston 5. The combustion accelerates the piston 5 toward the crankcase 4. Upon opening of the outlet 17, the exhaust gases flow out of the combustion chamber 3 and are scavenged by the largely fuel-free air that enters via the transfer windows 13 and 16.

Due to the division of the intake channel 22 downstream of the carburetor 19 into the mixture channel 10 and the supply channel 8, the fuel that is drawn into the intake channel 22 via the main fuel opening 26 and the auxiliary fuel openings 27 is supplied substantially to the mixture channel 10. At full throttle, in other words with the butterfly valve 24 completely open, the mixture channel 10 and the supply channel 8 are largely separated from one another, so that only very small quantities of fuel can pass into the supply channel 8. At low throttle and during idling, the butterfly valve 24 is substantially closed, so that the fuel substituents can also pass into the supply channel 8. In the substantially closed position of the butterfly valve 24, a considerable portion of the fuel can be supplied via the supply channel eight.

Figure 4:
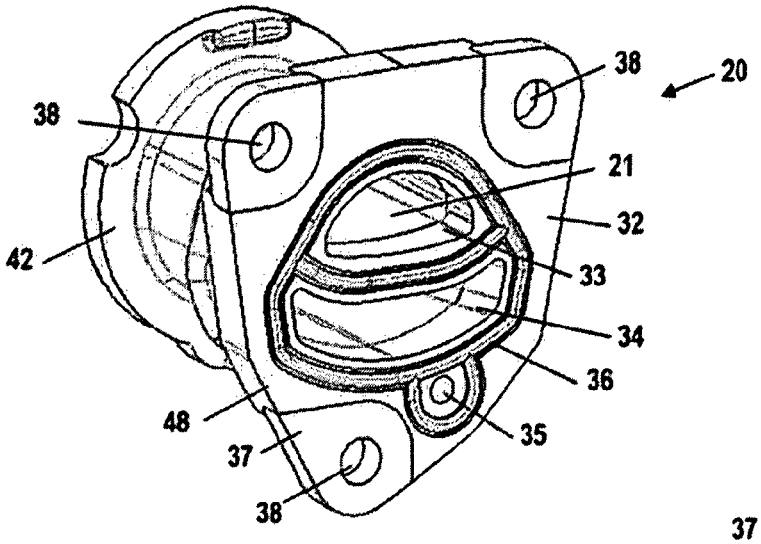
FIG. 4 is a perspective view of the intake adapter of FIG. 1.
Figure 5:
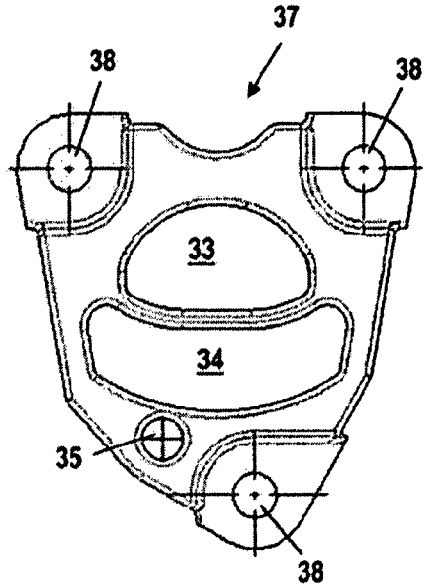
FIG. 5 is a plan view of the intake adapter of FIG. 4.
Figure 6:
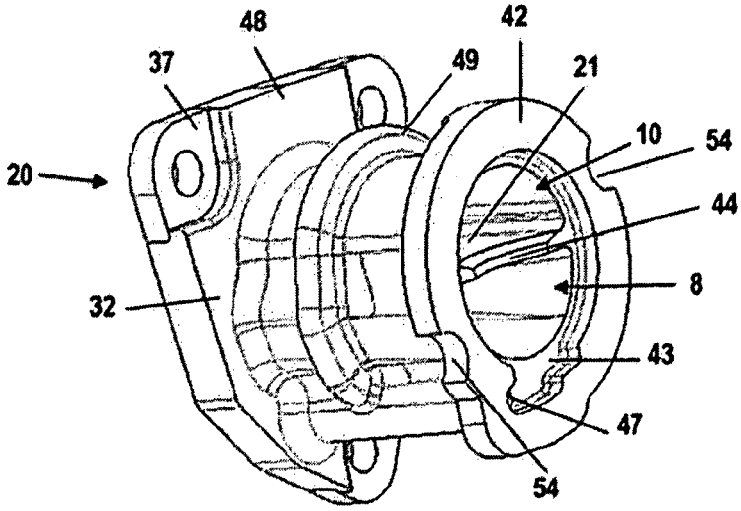
FIG. 6 is a perspective view of the intake adapter of FIG. 1.

In FIGS. 4 and 6 the intake adapter 20 is shown in perspective. The intake adapter 20 has a cylinder connection flange 32 for the connection to the cylinder connector 39. The intake adapter 20 is essentially made of an elastic material, in particular of an elastomeric plastic. The core 37, shown in FIG. 5 is injected or incorporated on the cylinder connection flange 32. The cylinder connection flange 32 has three mounting openings 38, whereby 2 of the mounting openings 38 are adjacent to an outlet opening 33 or the mixture channel 10, and one of the mountings 38 is disposed adjacent an outlet opening 34 for the supply channel 8. In the region of the mounting openings 38, the core 37 is not covered by the elastic material of the intake adapter 20. In the region between the mounting openings 38, the elastic material of the intake adapter 20 forms a casing or covering 48 that surrounds the core 37. The intake adapter 20 has a pulse channel, which will be described in greater detail subsequently and which opens out via an outlet opening 35 at the cylinder connection flange 32. The outlet openings 33 and 34 for the mixture channel 10 and the supply channel 8 respectively, as well as the outlet opening 35 for the pulse channel, are also formed in the core 37. The outlet openings 33, 34, and 35 are surrounded by a sealing bead 36 that extends out of the plane of the cylinder connection flange 32 to the cylinder connector 39, and in the installed state rests against the cylinder connector 39. The sealing bead 36 seals the mixture channel 10, the supply channel 8, and the pulse channel relative to one another and relative to the atmosphere.

For the connection to the carburetor 19, the intake adapter 20 had a carburetor connection flange 42. The carburetor connection flange 42 is provided with recesses 54 for mounting screws of the carburetor 19. Formed on the carburetor connection flange 42 is a receiving means 43 for the support ring 41, which is schematically shown in FIG. 1. An inlet opening 47 into the pulse channel opens out at the receiving means 43. The mixture channel 10 and the supply channel 8 are separated from one another by the partition 21 in the region of the carburetor connection flange 42. The partition 21 is recessed in the region of the recessed area 44 for the butterfly valve 24. At the cylinder connection flange 32, the partition 21 extends up to the end face. The sealing bead 36 between the outlet opening 33 and the outlet opening 34 is disposed on the partition 21.

Figure 7:
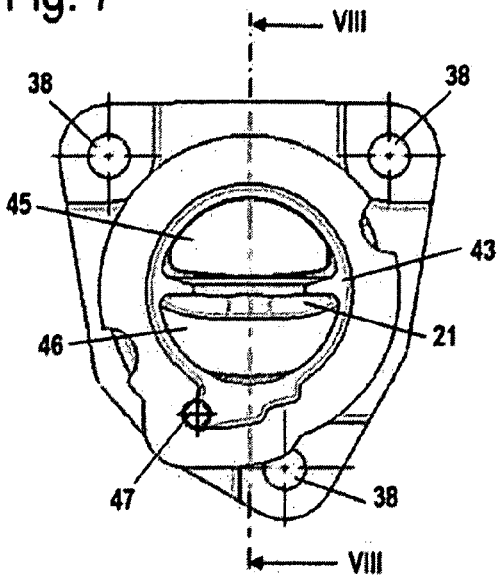
FIG. 7 is an end view of the intake adapter of FIG. 1.
Figure 8:
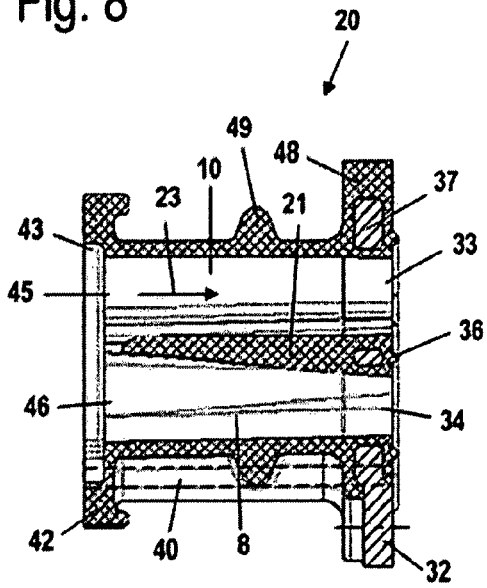
FIG. 8 is a cross-sectional view taken along the line of VIII-VII in FIG. 7.

As shown in FIGS. 7 and 8, formed on the carburetor connection flange 42 are an inlet opening 45 into the mixture channel 10 and an inlet opening 46 into the supply channel 8; the inlet openings 45 and 46 are separated from one another by the partition 21. The thickness of the partition 21 increases in the direction of flow 23, as shown in FIG. 8. The flow cross-section of the inlet opening 45 into the mixture channel 10 is smaller than is the flow cross-section of the inlet opening 46 into the supply channel 8. The partition 21 is eccentrically disposed in the intake channel 22. As shown in FIG. 4, also the flow cross-section of the outlet opening 34 out of the supply channel 8 is greater than the flow cross-section of the outlet opening 33 out of the mixture channel 10.

In FIG. 8, the pulse channel 40 is shown by dashed lines. The pulse channel 40 extends from the carburetor connection flange 42 to the cylinder connection flange 32. The intake adapter 20 has an annular outwardly facing reinforcing bead 49, which prevents a collapse of the intake adapter 20.

The intake adapter 20 can be produced in an injection molding process with a core. The core is advantageously essentially U-shaped, and has sections that form the mixture channel 10 and the supply channel 8. The two sections are interconnected at that side that faces the carburetor connection flange 42. The core additionally has a section that forms the pulse channel 40. Due to the fact that the core is drawn in a direction toward the carburetor connection flange 42, the covered core 37 does not obstruct the drawing of the core. In the region of the carburetor connection flange 42 there is no reinforcement, so that it is possible to expand the intake adapter beyond the core.

Figure 9:
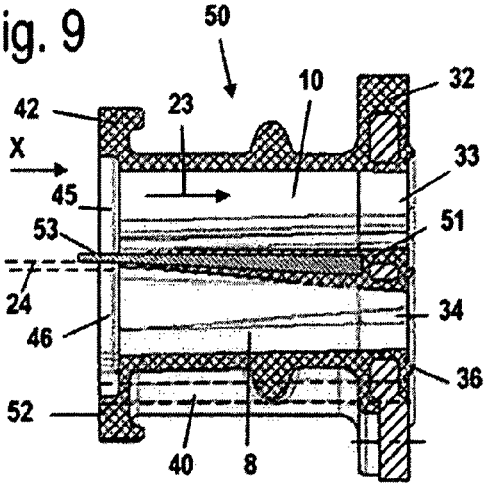
FIG. 9 is a cross-sectional view of an embodiment of an intake adapter.
Figure 10:
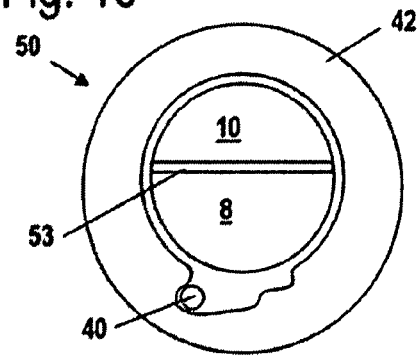
FIG. 10 is an end view of the intake adapter of FIG. 9 taken in the direction of the arrow X in FIG. 9.

FIGS. 9 and 10 show an embodiment of an intake adapter 50 that essentially corresponds to the intake adapter 20. The same reference numerals designate the same components. The intake adapter 50 has a partition 51 into which a reinforcement plate 53 is injected or incorporated. The reinforcement plate 53 is comprised of an inherently stable material, for example of a light metal such as aluminum or of an inherently stable polymeric material. The reinforcement plate 53 extends beyond the end face 52 of the intake adapter 50 that faces the carburetor, and into the portion of the intake channel 22 that is formed in the carburetor 19.

As shown in FIG. 10, the partition 51 is eccentrically disposed in the intake channel 22, being offset in a direction toward the mixture channel 10. As shown by dashed lines in FIG. 9, in the completely open position the butterfly valve 24 rests against the reinforcement plate 53. As a result, in the completely open position of the butterfly valve 24 the mixture channel 10 and the supply channel 8 are substantially separated from one another. As shown in FIG. 9, those sides of the reinforcement plate 53 that face the mixture channel 10 and the supply channel 8 can be covered with the material of the intake adapter 50. However, it would also be possible for only the longitudinal sides of the reinforcement plate 53 to be held in the conduits of the intake adapter 50.

Figure 12:
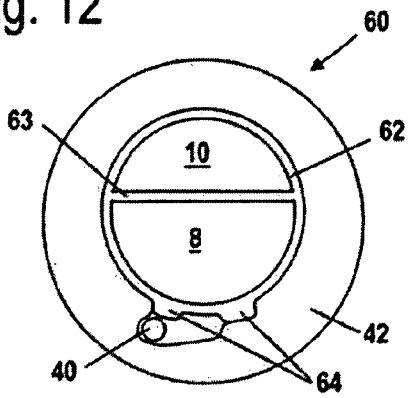
FIG. 12 is an end view of the intake adapter of FIG. 11 taken in the direction of the arrow XII in FIG. 11.
Figure 11:
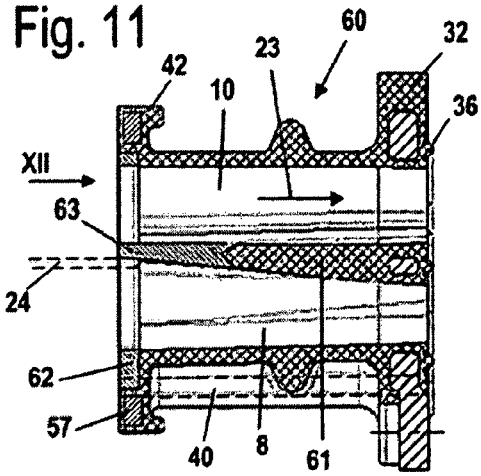
FIG. 11 is a cross-sectional view of an embodiment of an intake adapter.

In the embodiment of an intake adapter 60 illustrated in FIGS. 11 and 12, a support ring 62 is disposed on the carburetor connection flange 42. The support ring 62 can be pressed into the carburetor connection flange 42. In other respects, the intake adapter 60 essentially corresponds to the intake adapter 20. The carburetor connection flange 42 has a core 57 made of an inherently stable material such as, for example, metal that is covered by the material of the intake adapter 60 and reinforces the carburetor connection flange 42, so that a good sealing relative to the carburetor 19 results. The intake adapter 60 has a partition 61 that extends over the entire length of the intake adapter 60. In this connection, the length of the intake adapter 60 is the extension of the intake adapter in the direction of flow 23. A section 63 of the partition 61 is formed on the support ring 62. The section 63 flushly adjoins the carburetor connection flange 42 and does not extend into the carburetor 19. As shown in FIG. 11, in the completely opened position the butterfly valve 24 rests against the section 63. The section 63 of the partition 61, not only on the side facing the mixture channel 10 but also on the side facing the supply channel 8, overlaps a partition section that is made of elastic polymeric material and is monolithically formed with the intake adapter 60 so that the elastic partition section is fixed by the section 63 of the partition 61. As shown in FIG. 12, the support ring 62 has noses 64 that are disposed in the region of the pulse channel 40 and ensure a correct positioning of the support ring 62.

It should be noted that a partition can be provided not only with a reinforcement plate 53 but also with a support ring having formed thereon a section 63 of a partition.

Figure 13:
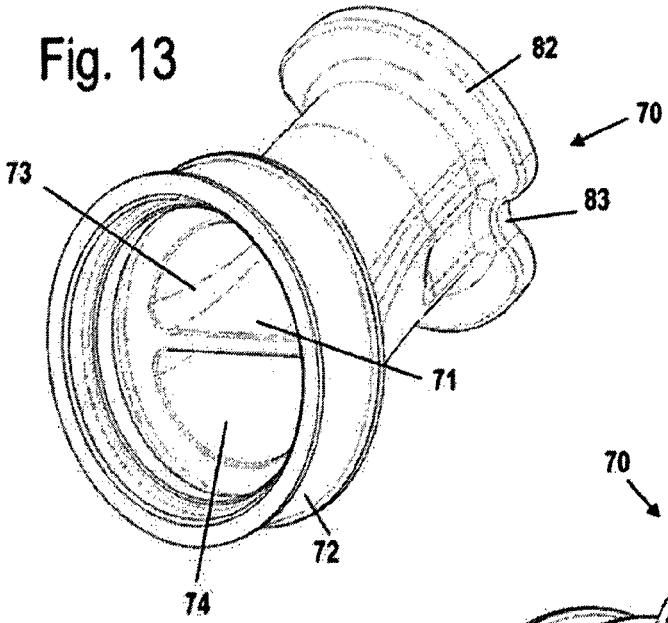
FIGS. 13 & 14 are perspective views of an intake adapter.
Figure 14:
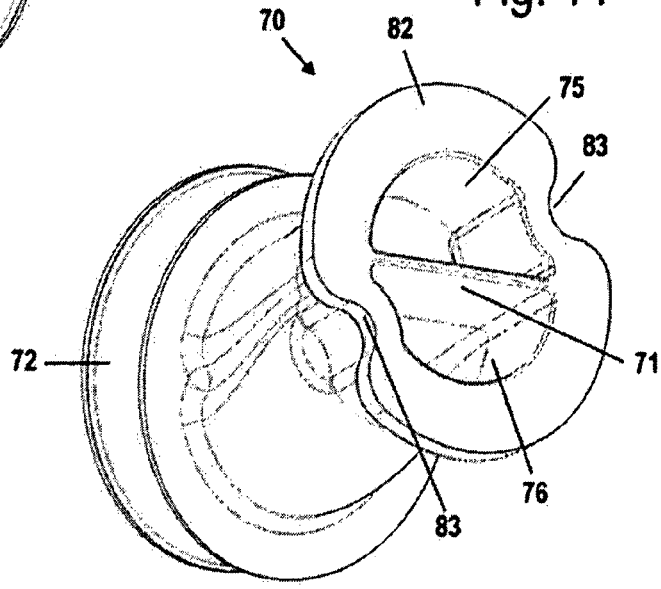
Figure 15:
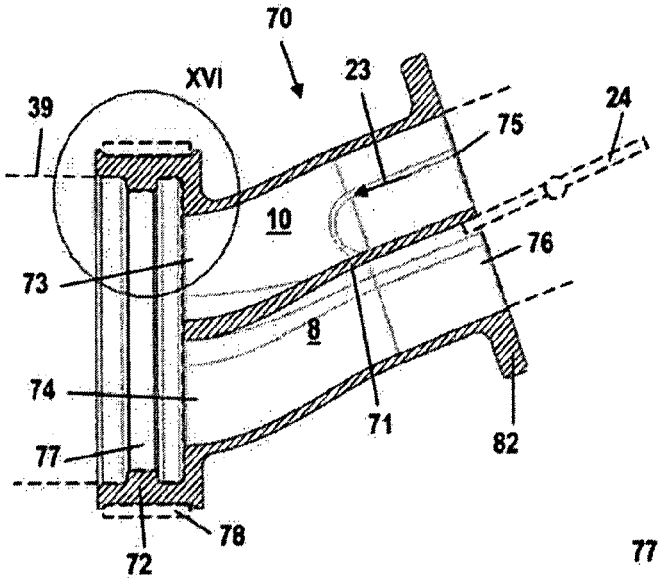
FIG. 15 is a longitudinal cross-sectional view through the intake adapter of FIGS. 13 and 14.

The intake adapter 70 shown in FIGS. 13 and 14 has a partition 71. The intake adapter 70 has a cylinder connection rim 72 via which the intake adapter 70 can be fixed to a cylinder connector 39 by means of a clamp or collar 78 or the like, as schematically shown in FIG. 15. The cylinder connection rim 72 rests in the radial direction against the cylinder connector 39 and provides sealing in the radial direction. At the opposite end, the intake adapter 70 is provided with a carburetor connection flange 82, which has recesses 83 for mounting screws of a carburetor. As shown in FIG. 13, the intake adapter 70 is provided on that side that faces the cylinder connection rim 72 with an outlet opening 73 for the mixture channel 10 and with an outlet opening 74 for the supply channel 8. No pulse channel is provided. On the carburetor connection flange 82, the intake adapter 70 has an inlet opening 75 into the mixture channel 10 and an inlet opening 76 into the supply channel 8.

Figure 16:
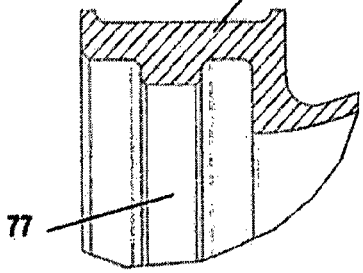
FIG. 16 is an enlarged view of the portion XVI of FIG. 15.

The partition 71 is centrally disposed in the portion of the intake channel 22 which is formed in the intake adapter 70. The inlet openings 75 and 76, as well as the outlet openings 73 and 74, respectively have the same flow cross-section. As shown in the cross-sectional view of FIG. 15, in the fully open position the butterfly valve 24 rests against the partition 71. However, a gap can also be provided between the butterfly valve 24 and the partition 71. The cylinder connection rim 72 overlaps the cylinder connector 39. For the fixation on the cylinder connector 39, the cylinder connection rim 72 is provided with the circumferential, inwardly facing securement bead 77 that is shown in FIG. 16 and that extends into a corresponding recessed portion of the cylinder connector 39. In this way, a sealing in the radial direction is achieved.

Figure 17:
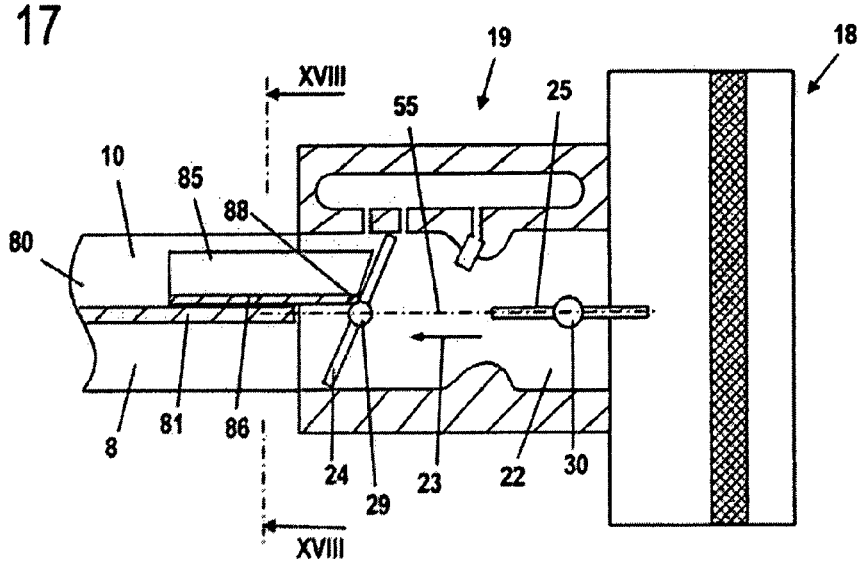
FIG. 17 is a schematic illustration of a carburetor having an intake adapter.
Figure 18:
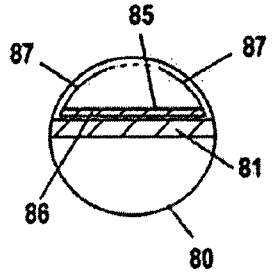
FIG. 18 is a cross-sectional view taken along the line XVIII-XVIII in FIG. 17.

An intake adapter 80 having a partition 81 is schematically shown in FIG. 17. The partition 81 extends to the end face of the carburetor 19. The configuration of the intake adapter 80 can, for example, correspond to the intake adapter 20 or to the intake adapter 70. As also shown in FIG. 18, in the intake adapter 80 a slide-in element 85 is inserted into the mixture channel 10. The slide-in element 85 has a base plate 86 that rests upon the partition 81. Toward the channel wall, the base plate 86 is supported via side elements 87, the shape of which corresponds to the shape of the channel wail and which can be resilient relative to the channel wall so that the slide-in element 85 can be reliable held in the intake adapter 80. As shown by dashed lines in FIG. 18, the two side elements 87 can be connected to one another. The slide-in element 85 thus rests against the entire periphery of the mixture channel 10. Instead of being disposed in the mixture channel 10, the slide-in element 85 can also be provided in the supply channel 8. The slide-in element 85 could also not be provided with any side elements 87, resting only against the partition 81. In this case, the slide-in element 85 can be wedged in the intake adapter 80 and/or can be held in the carburetor 19.

The slide-in element 85 extends to the shaft 29 of the butterfly valve 24 in the carburetor 19. As shown in FIG. 17, a sealing means 88 can be disposed on the slide-in element 85 that seals the gap between the slide-in element 85 and the butterfly valve shaft 29. As a result, in every position of the butterfly valve 24 a separation of the mixture channel 10 and the supply channel 8 is provided downstream of the butterfly valve shaft 29. A slide-in element 85 can also be provided for an intake adapter 80 that is not made of an elastic material but rather of an inherently stable material. The slide-in element 85 can also be inserted into the carburetor 19 and supported on the carburetor and extend into the intake adapter 80.

Figure 19:
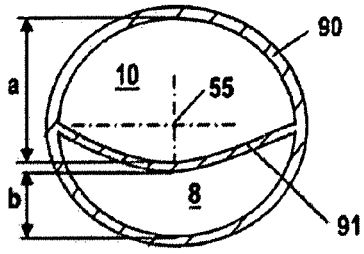
FIG. 19 is a cross-sectional view through an intake adapter.

FIG. 19 shows a cross-section through an intake adapter 90 having a partition 91 that is curved toward the supply channel 8. The mixture channel 10 has a height a, which is greater than the height b of the supply channel 8. The heights a and b are measured perpendicular to the partition 91 and to the longitudinal axis 55 of the intake channel. The effect of the curve of the partition 91 is that fuel from the main fuel opening 26 of the carburetor 19 that passes beyond the longitudinal axis 55 in the direction toward the supply channel 8 can still be introduced into the mixture channel 10. By providing the partition 91 with a curve, it is possible to avoid a curve in the opposite direction. The curve of the partition 91 forms a guide trough for the fuel.

Figure 20:
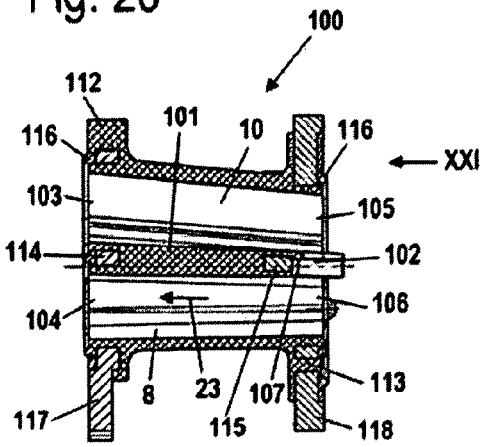
FIG. 20 is a cross-sectional view of an embodiment of an intake adapter.
Figure 21:
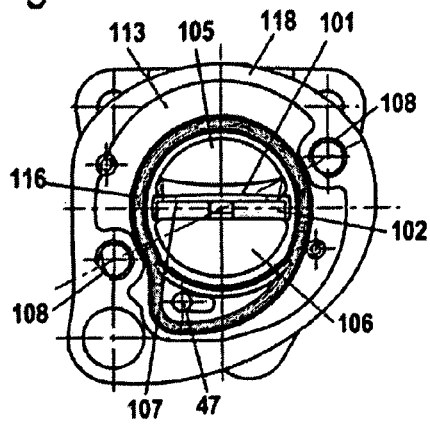
FIG. 21 is an end view of the intake adapter of FIG. 20 taken in the direction of the arrow XXI in FIG. 20.

FIGS. 20 and 21 show a further embodiment of an intake adapter 100. The intake adapter 100 is formed of an elastic material and has a cylinder connection flange 112 for the connection to the cylinder 2 of a two-cycle engine 1, and on the opposite end has a carburetor connection flange 113 for the connection to the carburetor 19. The intake adapter 100 has a partition 101 that extends over the entire length of the intake adapter 100 and divides the channel formed in the adapter 100 into a mixture channel 10 and a supply channel 8. Combustion air and fuel flow in the intake adapter 100 in the direction of flow 23.

Injected or incorporated on the cylinder connection flange 112 is a core 117 that in the region of non-illustrated mounting openings extends beyond the elastic region of the cylinder connection flange 112. The core 117 is formed of an inherently stable material, such as an inherently stable polymeric material or metal. The core 117 has an element 114 that is disposed in the region of the partition 101 and is covered by the elastic material of the intake adapter 100. The element 114 reinforces the partition 101 at the cylinder and side. In the region of the cylinder connection flange 112, the intake adapter 100 is provided with an outlet opening 103 for the mixture channel 10 as well as with an outlet opening 104 for the supply channel 8. The two openings 103 and 104 are separated from one another by the partition 101.

Provided on the carburetor connection flange 113 is a core 118 that is covered by the elastic material of the intake adapter 100. The edge region of the core 118 is not covered. The core 118 is also made of an inherently stable material, such as an inherently stable polymeric material or metal. At the carburetor end side the intake adapter 100 has an inlet opening 105 into the mixture channel 10 and an inlet opening 106 for the supply channel 8. The two openings 105 and 106 are separated from one another by the partition 101. Formed on the core 118 is an element 115 that extends in the region of the partition 101 and is covered by the material of the intake adapter 100. The element 115 reinforces the partition 101 in the region of the carburetor connection flange 113. When viewed in plan, the element 115 has the shape of a circular arc. The partition 101 extends beyond the carburetor connection flange 113 into the region of the carburetor 19. The partition 101 has a recessed area 102 for the butterfly valve 24. An abutment surface 107 for the butterfly valve 24 is disposed on the partition 101 at the recessed area 102. The abutment surface 107 can be embodied as a seal, and when the butterfly valve 24 is completely opened can separate the mixture channel 10 from the supply channel 8 in a fluidically sealed manner. A sealing bead 116 that separates the openings that open out at the flange from one another is formed not only on the cylinder connection flange 112 but also on the carburetor connection flange 113. On the cylinder connection flange 112 the sealing bead 116 extends about the outlet opening 103 and the outlet opening 104 as well as between the openings 103 and 104.

FIG. 21 shows an end view of the carburetor connection flange 113. As shown in FIG. 21, the sealing bead 116 extends about the inlet openings 105 and 106 as well as about the inlet opening 47 into a pulse channel. The sealing bead 116 is also disposed between the inlet opening 47 and the inlet opening 106 into the supply channel 8. As FIG. 21 also shows, the partition 101 is formed on the intake adapter 100 and is monolithically formed therewith. The core 118 has an edge region that extends beyond the elastic material of the carburetor connection flange 113. Formed in the carburetor connection flange 113 are mounting openings 108 that are also disposed in a region that is beyond the sealing bead 116 and in which the core 118 is not covered by elastic material.

An independent concept relates to the arrangement of a sealing element between the partition and the butterfly valve shaft downstream of the butterfly valve shaft. This concept can also be realized with an internal combustion engine that has no elastic connection adapter. A first embodiment for the sealing between partition and butterfly shaft is shown in FIG. 17. Further embodiments are shown in FIGS. 22 through 26.

Figure 22:
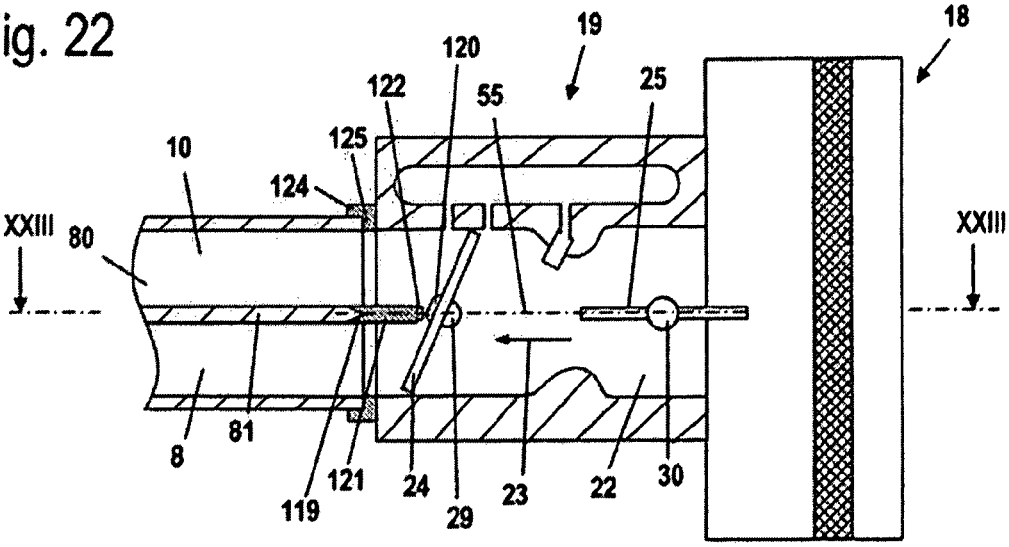
FIG. 22 is a view of a carburetor having an intake adapter.

In FIG. 22, an intermediate element or spacer 125 is disposed between the carburetor 19 and an intake adapter 80. The spacer 125 has an edge 124 that extends over the intake adapter 80 at that side thereof that faces the carburetor. The spacer 125 has a partition section 121 that is sealingly connected with the partition 81 of the intake adapter 80. For this purpose, the partition section 121 is provided on that side thereof that faces the partition 21 with a V-shaped recess 119 into which the partition 81 extends.

The partition section 121 extends to into the region of the butterfly valve shaft 29. As shown in FIG. 22, the butterfly valve 24 is fixed to the butterfly valve shaft 29 via a securement screw 120 from that side that faces the intake adapter 80. A sealing lip 122 is disposed on the partition section 120. The sealing lip 122 can be monolithically formed with the spacer 125, or can be secured to the spacer 125, for example in an adhesive manner.

Figure 23:
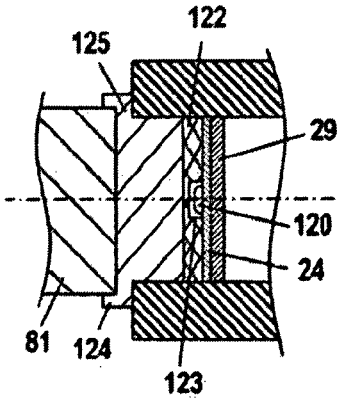
FIG. 23 is a partial cross-sectional view through the carburetor and intake adapter of FIG. 22.

FIG. 23 is a cross-sectional view through a portion of the arrangement having the spacer 125. The sealing lip 122 extends to the butterfly valve 24, and is embodied in such a way that it bridges the gap that results during the pivoting movement of the butterfly valve 24 and the width of which varies as a function of the position of the butterfly valve 24. In the region of the securement screw 120, the sealing lip 122 has a recess 123. Due to the small dimensions of the recess 123, passage of fuel from the mixture channel 10 into the supply channel 8 is largely prevented.

Figure 24:
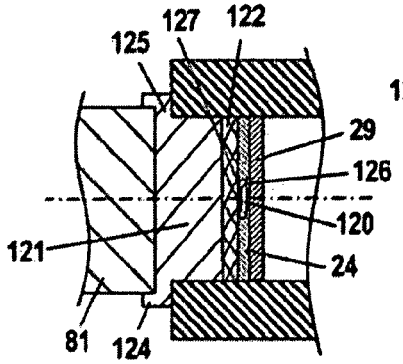
FIG. 24 is a partial cross-sectional view through an embodiment of an intake adapter.

FIG. 24 shows a further embodiment, in which in the region of the securement screw 120 the butterfly valve 24 has a recess 126 in which is disposed the head of the securement screw 120. The recess 126 can be closed off by a cover or cap 127. As a result, the spacing between the butterfly valve 24 and the partition section 121 is constant over the entire width of the intake channel and is bridged by the sealing lip 122. In this embodiment, the sealing lip 122 does not have a recess.

Figure 25:
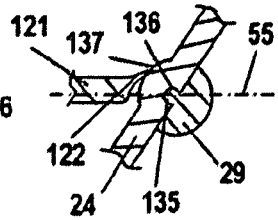
FIG. 25 is a partial cross-sectional view through an embodiment of a throttle element and a partition.

A further embodiment for the securement of the butterfly valve 24 and the butterfly valve shaft 29 is shown in FIG. 25. Here, a snap connection is provided between the butterfly valve shaft 29 and the butterfly valve 24. The shaft 29 has a pin 135 that snaps into a corresponding receiving means 136 of the butterfly valve 24. The butterfly valve 24, on that side opposite the shaft 29, is provided with a raised portion 137 that has a curved or bulged configuration and the radius of which corresponds to the radius of the butterfly valve shaft 29. As a result, when the butterfly valve 24 pivots, the spacing between the partition section 121 and the butterfly valve 24 remains constant. Formed on the partition section 121 is a sealing lip 122 that rests against the butterfly valve 24. That side of the sealing lip 122 that faces the mixture channel 10 extends tangentially relative to the periphery of the raised portion 137. As a result, fuel that is deposited on the butterfly valve 24 can be effectively wiped off by the sealing lip 122 during the closing movement of the butterfly valve 24, thus preventing passage of fuel into the supply channel 8.

Figure 26:
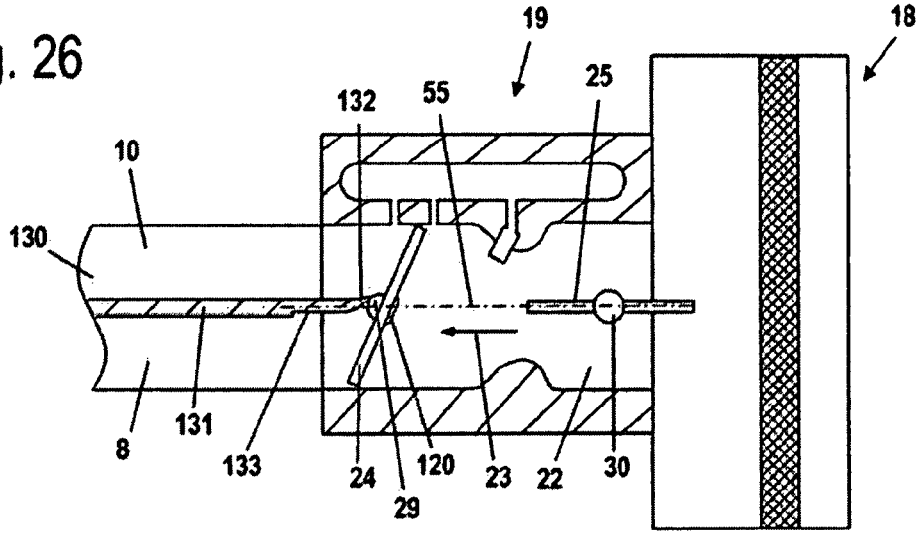
FIG. 26 is a view of a carburetor having an intake adapter.

A further embodiment is shown in FIG. 26. With this embodiment, the butterfly valve shaft 29, in the closed position of the butterfly valve 24 shown in FIG. 26, is disposed downstream of the butterfly valve 24 relative to the direction of flow 23. Disposed on the carburetor 19 is an intake adapter 130 that has a partition 131, which extends into the region of the butterfly valve shaft 29. Disposed adjacent to the butterfly valve shaft 29, on the partition 131, is a sealing lip 132 that can be made of the same elastic material as the intake adapter 130 and that can be produced in a single manufacturing step along with the intake adapter 130. On that side facing the supply channel 8 the partition 31 is provided with a recessed area 133 that has the configuration of a circular arc and in which the butterfly valve 24 rests in the completely opened position. Due to the fact that the securement screw 120 is disposed on that side of the butterfly valve 24 that is remote from the partition 131, the gap between the butterfly valve shaft 29 and the partition 131, and which is bridged by the sealing lip 132, is the same in every position of the butterfly valve 24. As a result a good sealing is achieved between the mixture channel 10 and the supply channel 8 in every position of the butterfly valve 24. The sealing lip 132 rests tangentially against the periphery of the butterfly valve shaft 29.

Figure 27:
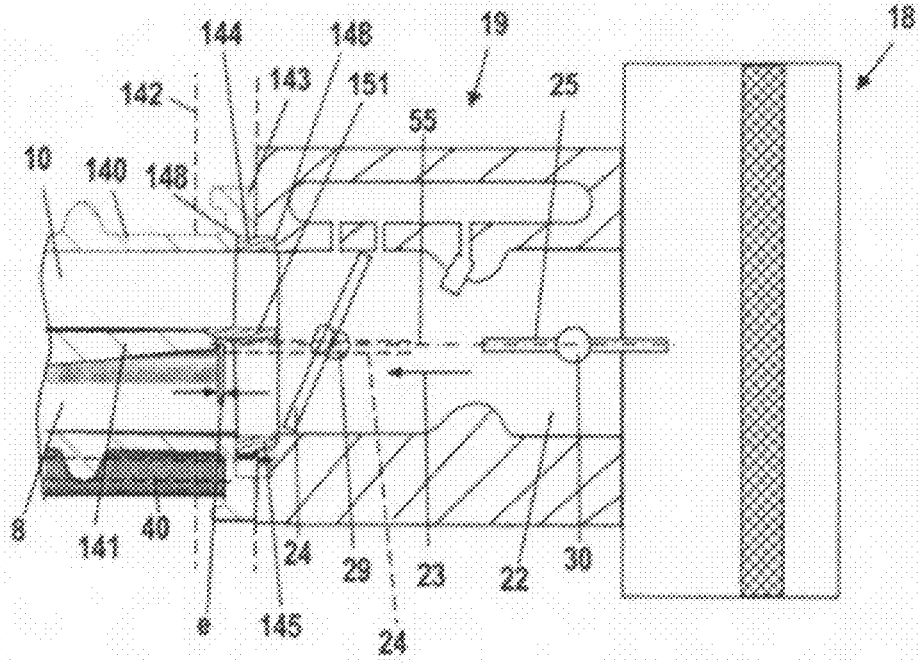
FIG. 27 is a partial cross-sectional view through a carburetor having an intake adapter.
Figure 28:
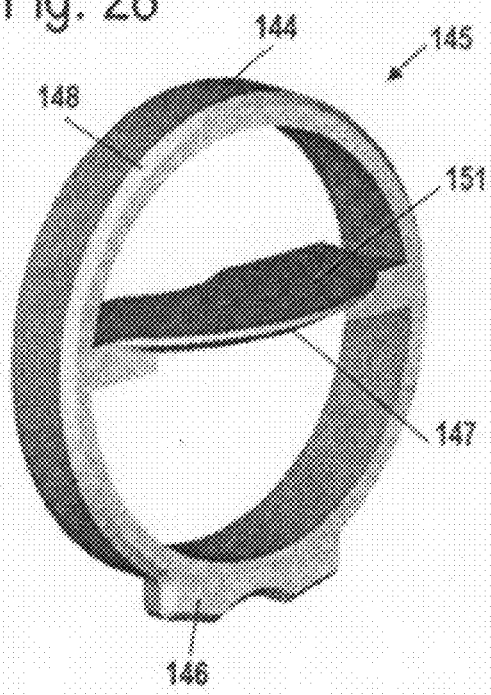
FIG. 28 is a perspective view of the intermediate element or spacer of FIG. 27.
Figure 29:
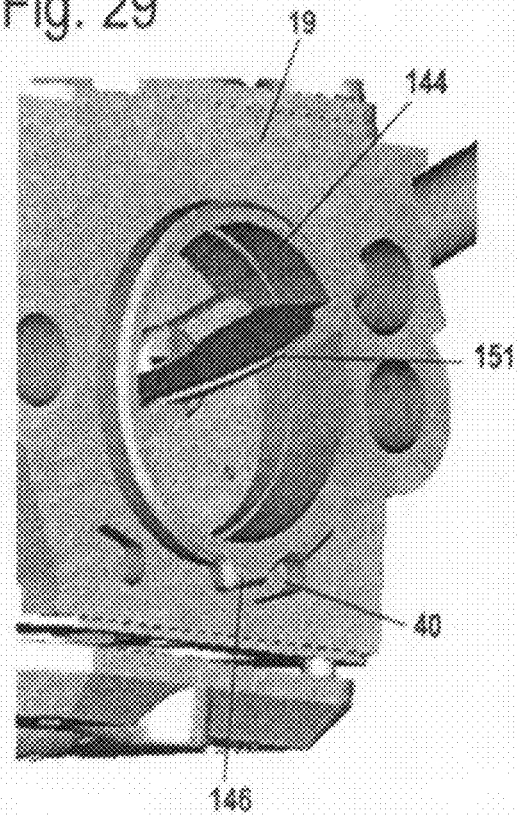
FIG. 29 is a perspective view of the spacer of FIG. 27 pressed into the carburetor.

FIG. 27 shows a further embodiment of an intake adapter 140. The intake adapter 140 has a partition 141 that divides the intake channel 22 in to the supply channel 8 and the mixture channel 10. The partition 141 ends at a distance, i.e. is spaced, from the endface of the carburetor 19. An intermediate element or spacer 145 is disposed between the carburetor 19 and the intake adapter 140. As also shown in FIGS. 28 and 29, the spacer 145 has an outer, essentially cylindrical rim 144 on which is held a partition section 151, which extends beyond the end face of the rim 144 toward the partition 141 and rests against the partition 141. For this purpose, the partition section 151 is provided with the chamfering 147 that is shown in FIG. 28 and that rests against the partition 141. As also shown in FIG. 28, when viewed in plan the partition section 151 has a partially circular shaped configuration.

When the butterfly valve 24 is completely open, the chamfering 147 cooperates with the partition 141 in the manner of a labyrinth seal. As a result, fuel is prevented from passing into the supply channel 8 when the butterfly valve 24 is in the full throttle position. A sealing part can be provided on the partition section 151 of the spacer 125; the sealing part extends to the butterfly valve shaft 29 and effects a sealing between the supply channel 8 and the mixture channel 10 even in the idling position, in other words with the butterfly valve 24 largely closed. As a result, in every operating state a separation is provided between the channels 8 and 10 downstream of the butterfly valve shaft 29.

The rim 144 of the spacer 145 is pressed into the carburetor 19. The connection between the rim 144 and the carburetor 19 is gas tight. As shown in FIG. 27, the intake adapter 140 has a carburetor connection flange 143 that overlaps the rim 144 of the spacer 145 and thus establishes a sealing connection between the intake adapter 140 and the rim 144. The carburetor connection flange 143 also rests in a sealing manner against the end face of the carburetor 19. Guided in the intake adapter 140 is a pulse channel 40 that at the end face of the intake adapter 140 opens out at the carburetor connection flange 143. The pulse channel 40 opens out at the outer side of the rim 144. By means of the rim 144 of the spacer 145, the pulse channel 40 is separated in a fluid-tight manner from the intake channel 22. As shown in FIGS. 28 and 29, the rim 144 has a sealing part 146 that extends in the region of the opening-out of the pulse channel 40 at the end face of the carburetor 19 and rests thereagainst. The pulse channel 40 is sealed off outwardly by the carburetor connection flange 143.

The carburetor connection flange 143 interengages in intermediate wall 142, which is shown by dashed lines in FIG. 27 and separates the two-cycle engine 1 from the carburetor 19 and from the air filter 18. The intermediate wall 142 advantageously rests against the end face of the carburetor 19 and presses the carburetor connection flange 143 against the end face of the carburetor 19, so that a sealing connection results.

In the position of the butterfly valve 24 indicated by dashed lines in FIG. 27, the partition 141 in the intake adapter 140 is spaced by a gap e relative to the butterfly valve 24. This prevents a jamming or binding of the butterfly valve 24 against the partition 141 in the completely opened state of the butterfly valve 24. In the completely opened state, the butterfly valve 24 can rest against the partition section 151. However, it would also be possible for the butterfly valve 24 to be spaced relative to the partition section 151. The spacer 145 forms a support ring for the partition 141 and rests thereagainst.

Each end face of the outer periphery of the ring or rim 144 has a beveling 148 to facilitate mounting on the carburetor 19 and mounting of the intake adapter 140 on the spacer 145. The ring 144 can also be pressed into the intake adapter 140.

Other embodiments for the sealing between a partition and the butterfly valve shaft 29 or butterfly valve 24 can also be provided. Furthermore, a partition section can also be provided upstream of the butterfly valve shaft 29 that similarly can be sealed relative to the shaft 29 by a sealing means. The illustrated embodiments of the arrangement of the sealing element can be combined in any desired manner with the various embodiments of butterfly valve and butterfly valve shaft.

The sealing element advantageously extends over the entire width of the butterfly valve shaft or throttle element. To simplify manufacture, however, it would also be possible to provide an interruption of the sealing lip, for example for the arrangement of a support element for the partition in the tool.

The specification incorporates by reference the disclosure of German priority document 10 2006 037 202.6 filed Aug. 9, 2006.

The present invention is, of course, in no way restricted to the specific disclosure of the specification and drawings, but also encompasses any modifications within the scope of the appended claims.

What we claim is:

1. An internal combustion engine having an intake channel for a supply of fuel and combustion air, comprising:

an elastic intake adapter, wherein a portion of the intake channel is guided in said intake adapter, wherein said intake adapter is provided with a partition that extends over at least a part of a length of said intake adapter, in the intake adapter, to divide said intake adapter, and hence said intake channel, into a mixture channel, and into a supply channel for supply of largely fuel-free air, wherein a flow cross-section of an inlet opening into said mixture channel is greater than a flow cross-section of an inlet opening into said supply channel, and wherein said partition is curved toward said supply channel.

2. An internal combustion channel according to claim 1, wherein said intake adapter is predominately comprised of a polymeric material, in particular of an elastomer.

3. An internal combustion engine according to claim 1, wherein said mixture channel and said supply channel are guided parallel to one another in said intake adapter, and wherein at an upstream end of said intake adapter the intake channel has a circular cross-section.

4. An internal combustion engine according to claim 1, wherein said intake adapter, in a region of an upstream end thereof, is provided with an inlet opening into said mixture channel and with an inlet opening into said supply channel, and wherein said inlet openings are separated from one another by means of said partition.

5. An internal combustion engine according to claim 1, wherein said partition centrally divides the intake channel.

6. An internal combustion engine according to claim 1, wherein a portion of the intake channel is formed in a carburetor, and wherein an upstream end of said intake adapter is disposed on the carburetor.

7. An internal combustion engine according to claim 6, wherein the intake channel is formed as non-divided conduits in the carburetor, or wherein a partition section is disposed in the carburetor that divides the intake channel.

8. An internal combustion engine according to claim 6, wherein an adjustable throttle or flow-control element is disposed in the carburetor that in at least one position, in the region of said partition, extends into said intake adapter, further wherein said throttle or flow-control element rests against said partition in at least one position, or wherein said partition has a recessed area for said throttle or flow-control element and in each position of said throttle or flow-control element a gap (d, e) exists between said partition and said throttle or flow-control element.

9. An internal combustion engine according to claim 1, wherein a downstream end of said intake adapter is provided with an outlet opening for said mixture channel and with an outlet opening for said supply channel, and wherein a flow cross-section of said outlet opening for said mixture channel is smaller than a flow cross-section of said outlet opening for said supply channel.

10. An internal combustion engine having an intake channel for a supply of fuel and combustion air, comprising:

an elastic intake adapter, wherein a portion of the intake channel is guided in said intake adapter, wherein said intake adapter is provided with a partition that extends over at least a part of a length of said intake adapter, in the intake adapter, to divide said intake adapter, and hence said intake channel, into a mixture channel, and into a supply channel for supply of largely fuel-free air, wherein said intake adapter is provided with a support ring on an upstream end of said intake adapter, further wherein said partition is provided with a section, further wherein said support ring and said section of said partition are made of an inherently stable material, and wherein said intake adapter is provided with a reinforcement plate of an inherently stable material that forms at least a portion of said partition.

11. An internal combustion engine having an intake channel for a supply of fuel and combustion air, comprising:

an elastic intake adapter, wherein a portion of the intake channel is guided in said intake adapter, wherein said intake adapter is provided with a partition that extends over at least a part of a length of said intake adapter, in the intake adapter, to divide said intake adapter, and hence said intake channel, into a mixture channel, and into a supply channel for supply of largely fuel-free air, wherein a portion of the intake channel is formed in a carburetor, wherein an upstream end of said intake adapter is disposed on the carburetor, wherein said intake adapter has a carburetor connection flange for connection to the carburetor, further wherein said carburetor connection flange forms an upstream end of said intake adapters, and wherein said carburetor connection flange is provided with a core of an inherently stable material that is at least partially covered by the elastic material of said intake adapter.

12. An internal combustion engine having an intake channel for a supply of fuel and combustion air, comprising:

an elastic intake adapter, wherein a portion of the intake channel is guided in said intake adapter, wherein said intake adapter is provided with a partition that extends over at least a part of a length of said intake adapter, in the intake adapter, to divide said intake adapter, and hence said intake channel, into a mixture channel, and into a supply channel for supply of largely fuel-free air, wherein said engine is provided with a cylinder having a cylinder connector, and wherein a downstream end of said intake adapter is disposed on the cylinder connector.

13. An internal combustion engine according to claim 12, wherein said intake adapter is provided with a cylinder connection flange for connection to the cylinder connector, and wherein said cylinder connection flange forms a downstream end of said intake adapter.

14. An internal combustion engine according to claim 13, wherein said cylinder connection flange is provided with three mounting openings.

15. An internal combustion engine according to claim 13, wherein said cylinder connection flange is provided with a core of inherently stable material that is at least partially covered by the elastic material of said intake adapter, and wherein in the region of said mounting openings said core is not covered.

16. An internal combustion engine according to claim 14, wherein said intake adapter is provided with at least one connection flange, and wherein said intake adapter is further provided with a sealing bead on said at least one connection flange that surrounds openings for said mixture channel and said supply channel.

17. An internal combustion engine according to claim 12, wherein said intake adapter is provided with a cylinder connection rim that overlaps the cylinder connector of the cylinder and forms said downstream end of said intake adapter.

18. An internal combustion engine having an intake channel for a supply of fuel and combustion air, comprising:

an elastic intake adapter, wherein a portion of the intake channel is guided in said intake adapter, wherein said intake adapter is provided with a partition that extends over at least a part of a length of said intake adapter, in the intake adapter, to divide said intake adapter, and hence said intake channel, into a mixture channel, and into a supply channel for supply of largely fuel-free air, wherein said intake adapter is provided with a pulse channel that extends from an upstream end of said intake adapter to a downstream end thereof.

19. An internal combustion engine having an intake channel for a supply of fuel and combustion air, comprising:

an elastic intake adapter, wherein a portion of the intake channel is guided in said intake adapter, wherein said intake adapter is provided with a partition that extends over at least a part of a length of said intake adapter, in the intake adapter, to divide said intake adapter, and hence said intake channel, into a mixture channel, and into a supply channel for supply of largely fuel-free air, wherein a portion of the intake channel is formed in a carburetor, wherein an upstream end of said intake adapter is disposed on the carburetor, wherein a slide-in element is inserted into said intake adapter and extends into the carburetor, and wherein said slide-in element separates said mixture channel and said supply channel from one another.

20. An internal combustion engine having an intake channel for a supply of fuel and combustion air, comprising:

an elastic intake adapter, wherein a portion of the intake channel is guided in said intake adapter, wherein said intake adapter is provided with a partition that extends over at least a part of a length of said intake adapter, in the intake adapter, to divide said intake adapter, and hence said intake channel, into a mixture channel, and into a supply channel for supply of largely fuel-free air, wherein a throttle or flow-control element is disposed in a carburetor, and wherein downstream of said throttle or flow-control element a sealing element is disposed on an element that forms a partition section.

21. An internal combustion engine having an intake channel for a supply of fuel and combustion air, comprising:

an elastic intake adapter, wherein a portion of the intake channel is guided in said intake adapter, wherein said intake adapter is provided with a partition that extends over at least a part of a length of said intake adapter, in the intake adapter, to divide said intake adapter, and hence said intake channel, into a mixture channel, and into a supply channel for supply of largely fuel-free air, wherein an intermediate element or spacer is disposed between a carburetor and said intake adapter.

22. An internal combustion engine according to claim 21, wherein said intermediate element or spacer is pressed into the carburetor in a gas tight manner.

23. An internal combustion engine according to claim 21, wherein said intermediate element or spacer is provided with a partition section that rests against said partition of said intake adapter.

* * * * *